US009272881B2

(12) United States Patent
Zhu et al.

(10) Patent No.: US 9,272,881 B2
(45) Date of Patent: Mar. 1, 2016

(54) MINING ELEVATOR

(75) Inventors: Zhencai Zhu, Xuzhou (CN); Guohua Cao, Xuzhou (CN); Jiancong Qin, Suzhou (CN); Hongqiao Kang, Suzhou (CN); Guoan Chen, Xuzhou (CN); Renyuan Wu, Xuzhou (CN); Gongbo Zhou, Xuzhou (CN); Wei Li, Xuzhou (CN); Yiping Ma, Suzhou (CN); Jianrong Yang, Suzhou (CN)

(73) Assignees: China University of Mining and Technology, Jiangsu (CN); Dongnan Elevator Co, Ltd, Jiangsu (CN)

( * ) Notice: Subject to any disclaimer, the term of this patent is extended or adjusted under 35 U.S.C. 154(b) by 0 days.

(21) Appl. No.: 13/982,477

(22) PCT Filed: Aug. 25, 2011

(86) PCT No.: PCT/CN2011/078883

§ 371 (c)(1),
(2), (4) Date: Jul. 29, 2013

(87) PCT Pub. No.: WO2013/007059

PCT Pub. Date: Jan. 17, 2013

(65) Prior Publication Data

US 2014/0110194 A1 Apr. 24, 2014

(30) Foreign Application Priority Data

Jul. 8, 2011 (CN) ..... 2011 1 0191149

(51) Int. Cl.
*B66B 11/02* (2006.01)
*B66B 7/04* (2006.01)
(Continued)

(52) U.S. Cl.
CPC . *B66B 17/00* (2013.01); *B66B 5/04* (2013.01); *B66B 5/16* (2013.01); *B66B 5/24* (2013.01); *B66B 7/02* (2013.01); *B66B 7/08* (2013.01); *B66B 15/08* (2013.01); *B66B 17/04* (2013.01)

(58) Field of Classification Search
CPC ..... B66B 5/04; B66B 5/044; B66B 5/062; B66B 5/08; B66B 5/24; B66B 7/02; B66B 7/047; B66B 7/06; B66B 17/04; B66B 7/062; B66B 7/08; E21D 7/02
See application file for complete search history.

(56) References Cited

U.S. PATENT DOCUMENTS 661,754 A * 11/1900 Burton ..... 187/367
719,852 A * 2/1903 Ortner ..... 187/407
(Continued)

FOREIGN PATENT DOCUMENTS

CN 201250042 Y 6/2009
CN 101475118 A 7/2009
(Continued)

OTHER PUBLICATIONS

CN201250042 English Translated.*
(Continued)

*Primary Examiner* — William E Dondero
*Assistant Examiner* — Minh Truong
(74) *Attorney, Agent, or Firm* — Seed IP Law Group PLLC

(57) ABSTRACT

A mine elevator is provided having an anti-explosion traction system, an anti-explosion lift car protection system, a flexible guide rail guiding system, a compound lift car, and a counterweight system. The anti-explosion traction system comprises a traction rope tension regulating device, an anti-explosion traction machine, and an anti-explosion control cabinet. The anti-explosion lift car protection system comprises a rope holder, a speed limiter, two hydraulic buffers, a safety clamp, a brake rope, and a brake rope tension buffer device. The flexible guide rail guiding system comprises a steel wire rope guide rail, a guide rail tension device connected to the steel wire rope guide rail and fixed to the an upper platform, a guide rail connection device connected to the steel wire rope guide rail and fixed to a lower platform, and a flexible guide rail guide sleeve fixed to the compound lift car and the counterweight system.

2 Claims, 4 Drawing Sheets

(51) Int. Cl.

| | |
|---|---|
| ***B66B 17/00*** | (2006.01) |
| ***B66B 5/04*** | (2006.01) |
| ***B66B 7/02*** | (2006.01) |
| ***B66B 17/04*** | (2006.01) |
| ***B66B 7/08*** | (2006.01) |
| ***B66B 5/16*** | (2006.01) |
| ***B66B 15/08*** | (2006.01) |
| ***B66B 5/24*** | (2006.01) |

(56) References Cited

U.S. PATENT DOCUMENTS

| | | | | | |
|---|---|---|---|---|---|
| 826,535 | A | * | 7/1906 | Burnham | 187/287 |
| 1,079,159 | A | * | 11/1913 | Bird | 187/367 |
| 1,443,882 | A | * | 1/1923 | Lydeard | 187/364 |
| 1,978,273 | A | * | 10/1934 | Lundberg et al. | 187/401 |
| 2,145,656 | A | * | 1/1939 | Hymans | 187/373 |
| 5,197,571 | A | * | 3/1993 | Burrell et al. | 187/350 |
| 5,226,507 | A | * | 7/1993 | Kawarasaki | 187/251 |
| 8,181,749 | B2 | * | 5/2012 | Okada | 187/287 |
| 2003/0217895 | A1 | * | 11/2003 | Kigawa et al. | 187/344 |
| 2004/0231312 | A1 | * | 11/2004 | Honda | 57/241 |
| 2011/0297489 | A1 | * | 12/2011 | Blanchard | 187/411 |
| 2012/0061189 | A1 | * | 3/2012 | Imfeld et al. | 187/350 |
| 2012/0132487 | A1 | * | 5/2012 | Araki Yassuda | 187/411 |

FOREIGN PATENT DOCUMENTS

| | | | |
|---|---|---|---|
| CN | 101955102 | A | 1/2011 |
| CN | 201737551 | U | 2/2011 |
| CN | 102001564 | A | 4/2011 |
| CN | 102020162 | A | 4/2011 |
| CN | 102085993 | A | 6/2011 |
| CN | 201873409 | U | 6/2011 |
| CN | 201873412 | U | 6/2011 |
| CN | 202156858 | U | 3/2012 |

OTHER PUBLICATIONS

CN201737551 English Translation.*

* cited by examiner

MINING ELEVATOR

BACKGROUND

1. Technical Field

The present disclosure relates to a mining elevator, which is especially suitable for lifting of materials mined underground and workers in mines.

2. Description of the Related Art

The workers and materials are mainly lifted and lowered by means of elevator and cage during the underground mining process in mines. However, for the underground mining at multiple-level working faces, in particular for lifting and lowering of materials and workers with the lifting height of less than 400 meters, the use of conventional elevators will lead to high cost and long construction cycle; in addition, when workers are lifted/lowered by means of an elevator, the occupants in the cage are unable to control the lifting/lowering process and are unable to transfer information to the well top or well bottom, and therefore cannot contact with the person at the well top or the well bottom in case that any emergency happens during the transport process; moreover, since the winch has a large structure and low mechanical efficiency, if the winch malfunctions during the operating process, the cage lacks an effective over-speed control; furthermore, lifting/lowering of elevator with cage causes poor ride comfort.

Though existing elevator systems provide better ride comfort, are suitable for working in multiple level working faces, and require low maintenance cost, the traction machine, control cabinet, and control box in the elevator car of existing ordinary industrial elevators can not meet the requirements of the harsh operating environments in mines, because explosive mixed gasses (methane, coal gas, etc.) and corrosive gasses exist in such environments; the rigid guide rails of existing ordinary industrial elevators cannot meet the requirements for lifting in mine wells, because the well shafts are apt to deform under huge side pressure; because the connecting devices of traction ropes employ compression spring and rubber material, which achieve buffering and vibration damping effects, but also may cause unbalanced tension of traction ropes after they are used over a period of time owing to the manufacturing error of traction ropes and the difference of materials; the existing safety clamp system can only be used in rigid guide rails for over-speed runaway safeguard, and there is no safety braking system for elevator cars of non-rigid guide rails up to now; though existing elevator cars can meet the demand for lifting of person and ordinary goods, and accomplish safe, reliable and comfortable lifting, they do not have the loading capability of mobile cars (e.g., mine cars) and therefore cannot be used for lifting in mines, because they do not have supporting device and car arrester. In summary, there are at least the following problems in the prior art:

1) For mining at multiple level working faces in mines, existing elevators have problems of high cost and long construction cycle;

2) The traction and control system of ordinary industrial elevators cannot meet the requirement for use in environments in mines where explosive and corrosive gases exist;

3) The rigid guide rails of existing elevators cannot meet the requirement for use in harsh conditions in mine wells where the shaft is apt to deform;

4) The connecting devices of traction ropes that employ compression spring and rubber material may cause unbalanced tension;

5) There is no safety protection system for elevator car of non-rigid guide rails;

6) There is no composite elevator car system for workers and cars which mine car can enter into and be lifted.

BRIEF SUMMARY

To overcome drawbacks in the prior art, embodiments of the present invention provide a mining elevator, which has compact structure and reliable braking capability, low maintenance cost, ride comfort, and high operating efficiency.

The mining elevator provided in accordance with embodiments of the present invention comprises an explosion-proof traction system and an explosion-proof elevator car protection system arranged on an upper platform on the top, a flexible guide rail guiding system arranged between the upper platform on the top and a lower platform in the bottom pit, a composite elevator car and a counterweight system that runs up and down along steel rope guide rails of the flexible guide rail guiding system.

The explosion-proof traction system comprises an explosion-proof traction machine connected to an explosion-proof control cabinet and a traction rope wound on the explosion-proof traction machine, wherein, one end of the traction rope is connected to a traction rope terminating device fixed to the upper platform on the top, and the other end of the traction rope is provided with a traction rope tension regulator fixed to the upper platform.

The explosion-proof elevator car protection system comprises a rope gripper, a speed limiter, a speed limiter rope, first and second hydraulic dampers, a braking rope connector, a speed limiter rope tensioner, a safety clamp, a safety clamp link mechanism, a braking rope, and a braking rope damping tensioner, wherein, the rope gripper is arranged on the traction rope between the traction machine and the guide pulleys, the speed limiter is fixed to the upper platform on the top, the first and second hydraulic dampers and the speed limiter rope tensioner are fixed to the lower platform in the bottom pit respectively, the speed limiter rope is connected between the speed limiter and the speed limiter rope tensioner, the upper end of the braking rope is connected to the braking rope damping tensioner and the lower end is connected to the braking rope connector, and a plurality of braking rope guiding sleeves and a safety clamp fixed to the composite elevator car are arranged on the braking rope.

The flexible guide rail guiding system comprises steel rope guide rails, guide rail tensioners fixed to the upper platform and connected to the upper end of the steel rope guide rails, and guide rail connectors fixed to the lower platform and connected to the lower end of the steel rope guide rails, wherein, a plurality of flexible guide rail guiding sleeves used to fix the composite elevator car are arranged on the steel rope guide rails.

The composite elevator car comprises a car body provided with a rail therein, and a follow cable suspended to the bottom of the car body, wherein, an explosion-proof control box for controlling is arranged in the car body, car arresters are arranged on the rail, and a supporting platform for access of a mine car is arranged at the entry of the composite elevator car.

The counterweight system comprises a counterweight for balancing with the composite elevator car, a compensating rope suspender arranged on the lower part of the counterweight, and a compensating rope connected to the compensating rope suspender.

The plurality of braking rope guiding sleeves are fixed to the two sides of the car body respectively, with three guide sleeves on each side, wherein, two braking rope guiding sleeves are fixed to the upper side and lower side of the safety clamp, and the rest braking rope guiding sleeve is fixed to the upper side of the car body; a braking rope groove is arranged in the safety clamp, and a safety clamp operating lever for controlling the safety clamp is arranged on the braking rope.

The mining elevator and aspects thereof disclosed in the present application employ an explosion-proof traction machine, an explosion-proof control cabinet, and a explosion-proof control box, and therefore overcomes the limitation that ordinary industrial elevators cannot be used in mine due to the existence of explosive gases, and improves operating safety and reliability of mining elevator; the employed traction rope tension regulator can balance the tension of the traction rope automatically, and therefore reduces the abrasion of the traction rope against the traction pulleys and improves the service life of the traction rope; the employed flexible guide rail can guide vertically and restrain transversal deflection in the lifting process of the elevator car, and thereby is suitable for use in an elevator guide rail system in mines where the rigid guide rails cannot meet the requirement since the shaft has lateral deformation, and can accelerate guide rail erection work in mine shafts, reduce the reinforcement rating of shaft wall, and reduce the cost of investment; the employed braking rope replaces the rigid guide rail used in safety clamp, introduces a braking rope damping tensioner, and therefore improves the elevator car's braking safety and reliability under an out-of-control condition due to speeding, stalling, and broken rope, etc., and overcomes the limitation that the existing elevators can only be braked with the rigid guide rail; the introduced supporting device for access of a mine car and car arresters for preventing the mine car from moving freely, extends the transportation function of elevator car and improves the utilization ratio of elevator car; the employed compensating rope suspender, which can be used to fix compensating ropes with different diameters, allows for determining the position of the fixing end of the compensating rope as required, as a result, it can accelerate the compensating rope connection speed and improve compensating rope reliability, as well as expand the species of compensating ropes. The mining elevator changes the situation that the vertical transportation of workers and materials has to be accomplished by elevator and cage in the mining industry, and solves the problems of high cost and long construction cycle when existing elevators are used for the mining work at multiple-level working faces in mines. The mining elevator and aspects thereof disclosed in the present application are suitable for use in harsh environments in mines where explosive gases and shaft deformation exist, and can achieve reliable braking, low maintenance cost, ride comfort, high operating efficiency and wide applicability.

DETAILED DESCRIPTION

Hereunder the present invention will be detailed in embodiments with reference to the accompanying drawings.

Figure 1:
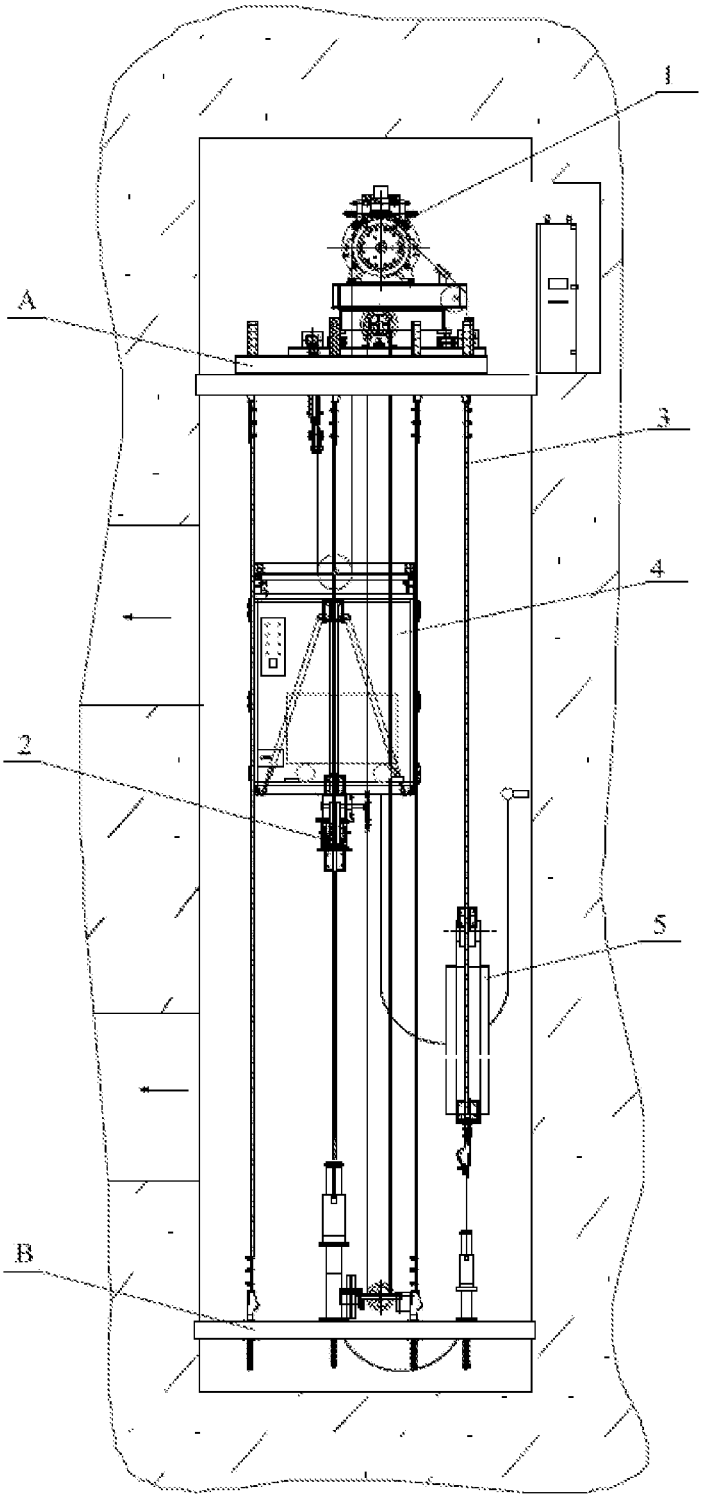
FIG. 1 is a systematic front view of the system of the mining elevator disclosed in the present application.

As shown in FIG. 1, the mining elevator disclosed in the present application comprises an explosion-proof traction system 1, an explosion-proof elevator car protection system 2, a flexible guide rail guiding system 3, a composite elevator car 4, and a counterweight system 5, wherein, the explosion-proof traction system 1 is arranged on an upper platform A on the top at the well top, and the flexible guide rail guiding system 3, composite elevator car 4, and counterweight system 5 are arranged between the upper platform A on the top and a lower platform B in a bottom pit respectively.

Figure 2:
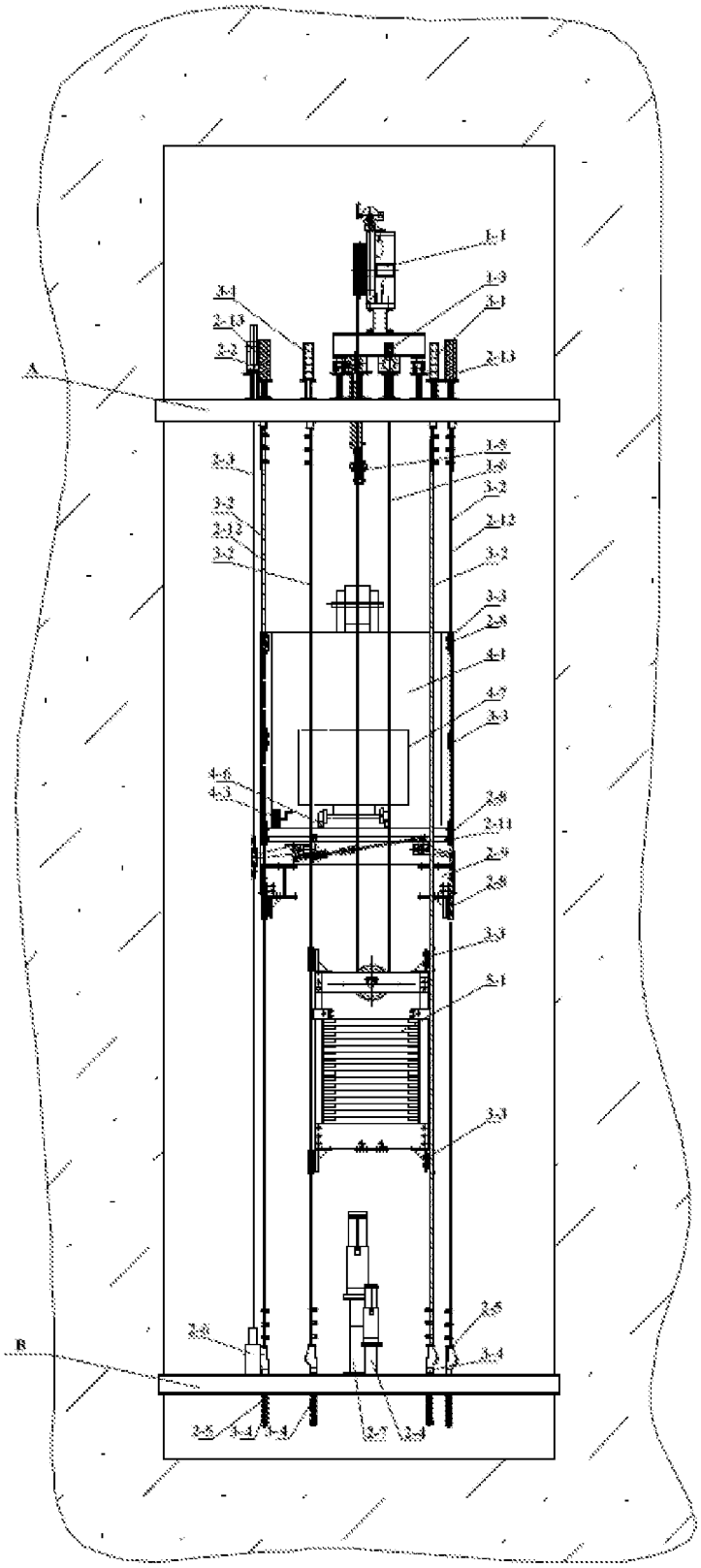
FIG. 2 is a front view of the structure of the mining elevator disclosed in the present application.
Figure 3:
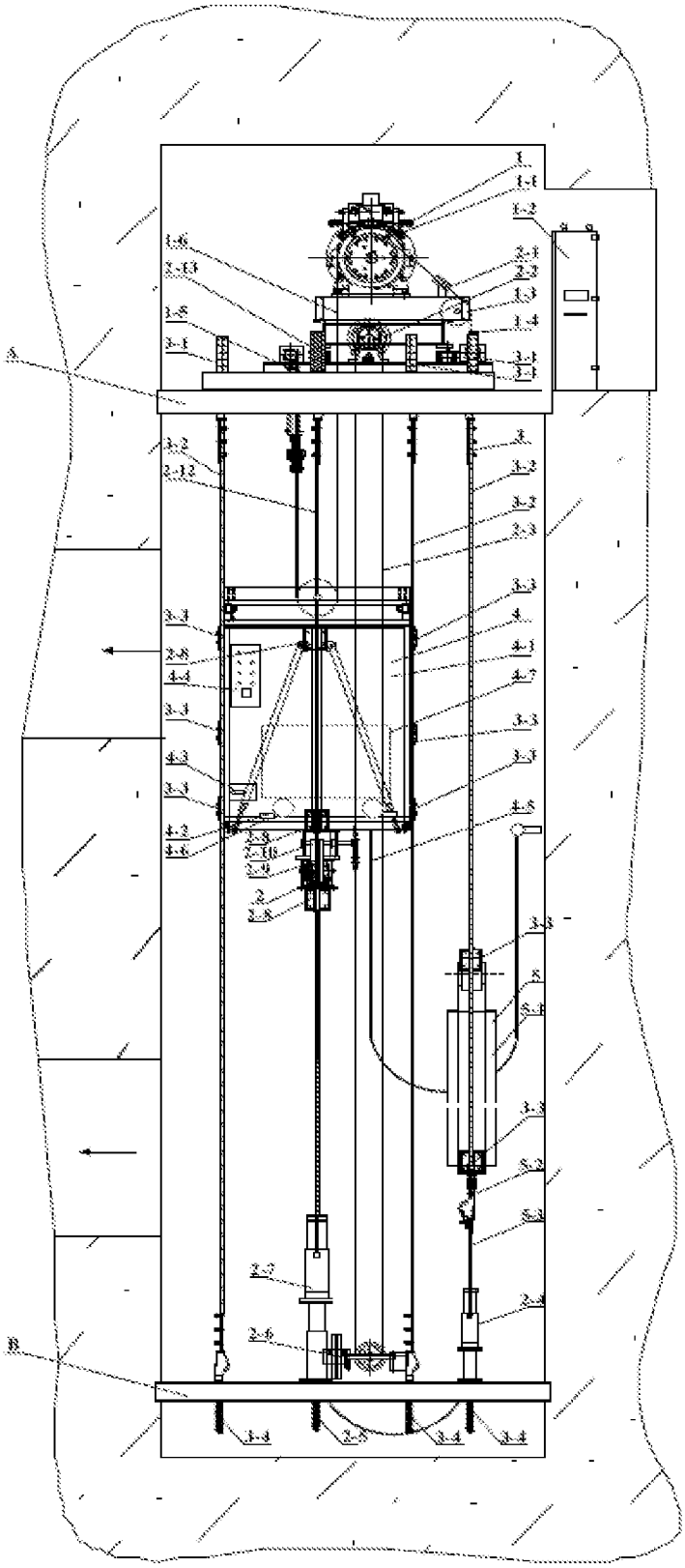
FIG. 3 is a side view of the structure of the mining elevator disclosed in the present application.
Figure 4:
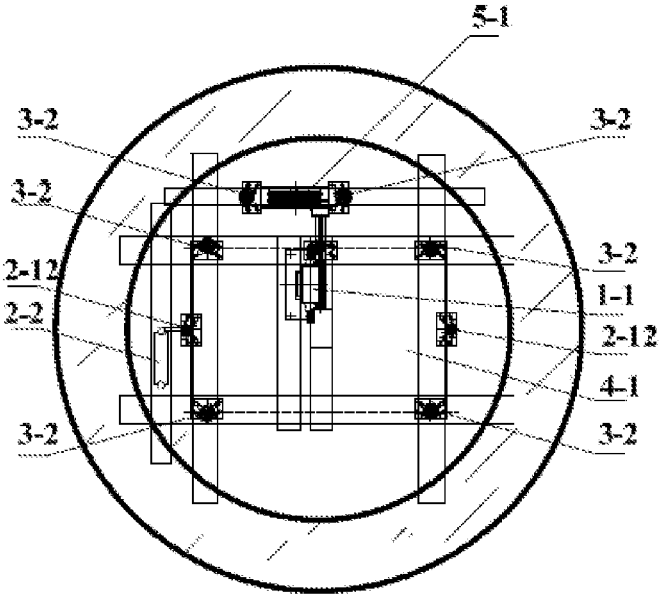
FIG. 4 is a top view of the structure of the mining elevator disclosed in the present application.

As shown in FIGS. 2-4, the explosion-proof traction system 1 comprises an explosion-proof traction machine 1-1 connected to an explosion-proof control cabinet 1-2 arranged on the upper platform A, and a traction rope 1-6 wound on the explosion-proof traction machine 1-1, with one end of the traction rope 1-6 being connected to a traction rope terminating device 1-4 fixed to the upper platform A on the top via guide pulleys 1-3, and the other end of the traction rope 1-6 being connected to a traction rope tension regulator 1-5 fixed to the upper platform A on the top; the traction rope terminating device 1-4 is a terminating device commonly used in existing elevators, and usually comprises a wedge-shaped rope sleeve and a rope sleeve screw rod; the traction rope tension regulator 1-5 comprises hydraulic cylinders communicated with each other and a connecting plate for fixing the hydraulic cylinders, wherein, the plungers in the cylinders are connected to the traction rope 1-6, and the connecting plate for fixing the cylinders is arranged on the upper platform A, so as to achieve automatic balancing for the tension of traction rope 1-6.

The explosion-proof elevator car protection system 2 comprises a rope gripper 2-1, a speed limiter 2-2, a speed limiter rope 2-3, first and second hydraulic dampers 2-4 and 2-7, a braking rope connector 2-5, a speed limiter rope tensioner 2-6, a safety clamp 2-10, a safety clamp link mechanism 2-11, a braking rope 2-12, and a braking rope damping tensioner 2-13, wherein, the speed limiter 2-2 is fixed to the upper platform A on the top; the second hydraulic damper 2-7 under the car body 4-1, the first hydraulic damper 2-4 under the counterweight 5-1, and the speed limiter rope tensioner 2-6 are fixed to the lower platform B in the bottom pit respectively; the speed limiter rope 2-3 is connected between the speed limiter 2-2 and the speed limiter rope tensioner 2-6; the upper end of the braking rope 2-12 is connected to the braking rope damping tensioner 2-13 fixed to the upper platform A on the top, and the lower end of the braking rope 2-12 is connected to the braking rope connector 2-5; a plurality of braking rope guiding sleeves 2-8 and a safety clamp 2-9 for fixing the composite elevator car 4 are arranged on the braking rope 2-12; a plurality of braking rope guiding sleeves 2-8 are fixed to the two sides of the car body 4-1 respectively, with three guiding sleeves 2-8 on each side, wherein, two guiding sleeves are fixed to the upper side and lower side of the safety clamp 2-9, and the other guiding sleeve is fixed to the upper side of the composite elevator car 4; the speed limiter rope 2-3 wound in loops on the speed limiter 2-2 and speed limiter rope tensioner 2-6 is connected to the safety clamp link mechanism 2-11. The braking rope connector 2-5 comprises a wedge-shaped rope sleeve and a rupturable rope sleeve screw rod; the speed limiter rope tensioner is a tensioner commonly used in conventional elevators; the braking rope damping tensioner comprises a force regulating mechanism for setting the resistance, and the braking rope runs through the force regulating mechanism and is tensioned up; the safety clamp link mechanism 2-11 is a safety clamp link mechanism commonly used on conventional elevators with rigid guide rails.

The flexible guide rail guiding system 3 comprises steel rope guide rails 3-2, guide rail tensioners 3-1 for fixing the upper end of the steel rope guide rails 3-2, and guide rail connectors 3-4 for fixing the lower end of the steel rope guide rails 3-2, wherein, the guide rail tensioners 3-1 are fixed to the upper platform A, and the guide rail connectors 3-4 are fixed to the lower platform B; the steel rope guide rails 3-2 on the platform are arranged on two sides of the car body 4-1 and counterweight 5-1, wherein, 1 to 2 flexible steel rope guide rails 3-2 are arranged on each side of the car body 4-1, and 1 flexible steel rope guide rail 3-2 is arranged on each side of the counterweight 5-1; a plurality of flexible guide rail guiding sleeves 3-3 for fixing the composite elevator car 4 and vertically passed through by the steel rope guide rails 3-2 are arranged on the steel rope guide rails 3-2; the guide rail tensioner 3-1 comprises a rope gripper and a hydraulic cylinder, wherein, the steel rope guide rail 3-2 is arranged in the middle of the rope gripper, and is held tightly therein, and the tension force of the rope gripper is adjusted by the hydraulic cylinder; the guide rail connector 3-4 can comprise a wedge-shaped rope sleeve and a rope sleeve screw rod.

The composite elevator car 4 comprises a car body 4-1 with a rail 4-6 provided in it, and a trailing cable 4-5 suspended to the bottom of the car body 4-1, wherein, an explosion-proof control box 4-4 for controlling is arranged in the car body 4-1, car arresters 4-2 are arranged at the two sides of the rail 4-6, and a supporting platform 4-3 for access of a mine car 4-7 is arranged at the entry of the composite elevator car; the supporting platform 4-3 extends from the car body 4-1 toward the shaft wall, to facilitate the mine car 4-2 to access via the rail 4-6 in the car body 4-1, and the car arresters 4-2 can conveniently restrain the mine car 4-7 from moving freely in the car body 4-1.

The counterweight system 5 comprises a counterweight 5-1 for balancing with the composite elevator car 4, a compensating rope suspender 5-2 arranged on the lower part of the counterweight 5-1, and a compensating rope 5-3. The compensating rope suspender 5-2 comprises a wedge-shaped rope gripper connected to the compensating rope 5-3 and a terminator that fixes the rope gripper and can rotate, which can be used to fix compensating ropes 5-3 with different diameters.

Operating process: a mobile car (i.e., mine car 4-7) is pushed into the car body 4-1 via a supporting device (e.g., supporting platform 4-3) in the car body 4-1, and is fixed by the car arresters 4-2. The explosion-proof traction machine 1-1 is controlled by the explosion-proof control box 4-4 in the elevator car 4-1 to act, and the traction rope 1-6 balanced dynamically by the fraction rope tension regulator 1-5 drives the composite elevator car 4 and counterweight 5-1 to run as required in the well shaft. Constrained by the flexible guide rail guiding sleeves 3-3, the composite elevator car 4 and counterweight 5-1 run up and down along the flexible steel rope guide rails 3-2 on the two sides thereof When the composite elevator car 4 is lifted to a specific position, the supporting platform 4-3 in the car body 4-1 is pushed out, the arresting function of the car arresters 4-2 is relieved, and the mobile car (e.g., mine car 4-7) can be pushed out of the car body 4-1. In case the composite elevator car 4 is in a speeding or stalling state, the speed limiter rope 2-3 is triggered by the speed limiter 2-2 to brake; when the composite elevator car 4 slides down, the speed limiter rope 2-3 pulls up an operating lever of the safety clamp 2-9 via the safety clamp link mechanism 2-11 on the bottom of the car body 4-1, and the safety clamp 2-9 acts and rests on the braking rope 2-12, so as to prevent the composite elevator car 4 from falling; in case the composite elevator car 4 and counterweight 5-1 touch the ground as a result of lifting failure, the first and second hydraulic dampers 2-4 and 2-7 on the bottom will provide a damping effect; in case the composite elevator car 4 and counterweight 5-1 hit the ceiling, the rope gripper 2-1 will exercise braking and provide protection. Aspects of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A mining elevator operable between an upper platform and a lower platform, the mining elevator comprising:

an explosion-proof traction system;

an explosion-proof elevator car protection system;

a flexible guide rail guiding system arranged between the upper platform and the lower platform; and a composite elevator car and a counterweight system that run up and down along a guide rail of the flexible guide rail guiding system;

wherein the explosion-proof traction system comprises an explosion-proof traction machine connected to an explosion-proof control cabinet and a traction rope wound on the explosion-proof traction machine, wherein, one end of the traction rope is connected to a traction rope terminating device fixed to the upper platform, and the other end of the traction rope is provided with a traction rope tension regulator fixed to the upper platform;

wherein the explosion-proof elevator car protection system comprises a rope gripper, a speed limiter, a speed limiter rope, first and second hydraulic dampers, a braking rope connector, a speed limiter rope tensioner, a safety clamp, a safety clamp link mechanism, a braking rope, and a braking rope damping tensioner, wherein, the rope gripper is arranged on the traction rope between the traction machine and at least one guide pulley, the speed limiter is fixed to the upper platform, the first and second hydraulic dampers and the speed limiter rope tensioner are fixed to the lower platform, the speed limiter rope is connected between the speed limiter and the speed limiter rope tensioner, an upper end of the braking rope is connected to the braking rope damping tensioner and a lower end is connected to the braking rope connector, and a plurality of braking rope guiding sleeves and the safety clamp fixed to the composite elevator car are arranged on the braking rope;

wherein the flexible guide rail guiding system comprises steel rope guide rails, guide rail tensioners fixed to the upper platform and connected to an upper end of the steel rope guide rails, and guide rail connectors fixed to the lower platform and connected to a lower end of the steel rope guide rails, wherein, a plurality of flexible guide rail guiding sleeves fixed to the composite elevator car are arranged on the steel rope guide rails;

wherein the composite elevator car comprises a car body with a rail provided in the car body, and a trailing cable suspended to a bottom of the car body, wherein, an explosion-proof control box for controlling is arranged in the car body, car arresters are arranged on the rail, and a supporting platform for access of a mine car is arranged atan entry of the composite elevator car;

wherein the counterweight system comprises a counterweight for balancing with the composite elevator car, a compensating rope suspender arranged on a lower part of the counterweight, and a compensating rope connected to the compensating rope suspender; and wherein a plurality of braking rope guide sleeves are fixed to two sides of the car body respectively, with three guide sleeves on each side, wherein two guide sleeves are fixed to an upper side and a lower side of the safety clamp, and the other guide sleeve is fixed to an upper side of the car body.

2. The mining elevator according to claim 1, wherein the safety clamp has a braking rope groove, and wherein a safety clamp operating lever for controlling the safety clamp is arranged on the braking rope.

* * * * *

UNITED STATES PATENT AND TRADEMARK OFFICE

CERTIFICATE OF CORRECTION

PATENT NO. : 9,272,881 B2
APPLICATION NO. : 13/982477
DATED : March 1, 2016
INVENTOR(S) : Zhencai Zhu et al.

It is certified that error appears in the above-identified patent and that said Letters Patent is hereby corrected as shown below:

Claims

Column 6, Line 64, claim 1:
"arranged atan entry of the composite elevator car;" should read, --arranged at an entry of the composite elevator car;--.

Signed and Sealed this
Twenty-sixth Day of July, 2016

Michelle K. Lee

Michelle K. Lee
*Director of the United States Patent and Trademark Office*